US009604086B2

(12) United States Patent
Meredith et al.

(10) Patent No.: US 9,604,086 B2
(45) Date of Patent: Mar. 28, 2017

(54) ASSISTED CHIN/DIP EXERCISE APPARATUS WITH ADJUSTABLE CHIN-UP/PULL-UP HANDLES

(71) Applicant: Hoist Fitness Systems, Inc., Poway, CA (US)

(72) Inventors: Jeffrey Owen Meredith, San Diego, CA (US); Billy Y. Kim, San Diego, CA (US); Adam Sanders Guier, San Diego, CA (US)

(73) Assignee: Hoist Fitness Systems, Inc., Poway, CA (US)

( * ) Notice: Subject to any disclaimer, the term of this patent is extended or adjusted under 35 U.S.C. 154(b) by 0 days.

(21) Appl. No.: 14/689,917

(22) Filed: Apr. 17, 2015

(65) Prior Publication Data

US 2015/0217156 A1 Aug. 6, 2015

Related U.S. Application Data

(62) Division of application No. 13/493,205, filed on Jun. 11, 2012, now Pat. No. 9,017,238.

(Continued)

(51) Int. Cl.
*A63B 1/00* (2006.01)
*A63B 21/00* (2006.01)

(Continued)

(52) U.S. Cl.
CPC ..... *A63B 1/00* (2013.01); *A63B 21/00181* (2013.01); *A63B 21/062* (2013.01);

(Continued)

(58) Field of Classification Search
CPC ..... A63B 21/00181; A63B 21/068; A63B 21/1465–21/1469; A63B 23/1218; A63B 23/1227

See application file for complete search history.

(56) References Cited

U.S. PATENT DOCUMENTS 5,011,139 A * 4/1991 Towley, III ..... 482/38
5,209,715 A * 5/1993 Walker et al. ..... 482/137

(Continued)

FOREIGN PATENT DOCUMENTS

KR 1020090042700 A 4/2009

OTHER PUBLICATIONS

Hoist Fitness Systems, CD2700 Weight Dip-Chin Assist, Owners Manual, Apr 2003.

(Continued)

*Primary Examiner* — Loan H Thanh
*Assistant Examiner* — Jennifer M Deichl
(74) *Attorney, Agent, or Firm* — Jones Day

(57) ABSTRACT

An assisted chin/dip exercise apparatus has a main frame and an assist or foot bar pivotally mounted on the frame and linked to a weight stack or resistance for assisting a user standing on the foot bar during performance of chin and dip exercises. The main frame has a first, overhead handle assembly and a second, dip handle assembly below the first handle assembly. The first handle assembly includes a pair of adjustably mounted handles freely pivotable between a first, chin-up position in which the handles extend towards one another at a rearward angle with a small spacing between the handles and a second, pull-up position in which the handles extend in a forward direction and are spaced apart by a larger spacing sufficient to provide head clearance for a user stepping onto the foot bar or while performing a dip exercise.

20 Claims, 15 Drawing Sheets

Related U.S. Application Data

(60) Provisional application No. 61/500,384, filed on Jun. 23, 2011.

(51) Int. Cl.
*A63B 21/062* (2006.01)
*A63B 23/12* (2006.01)

(52) U.S. Cl.
CPC ..... *A63B 21/0628* (2015.10); *A63B 21/4035* (2015.10); *A63B 23/1218* (2013.01); *A63B 23/1227* (2013.01); *A63B 21/4034* (2015.10); *A63B 2225/09* (2013.01); *A63B 2225/10* (2013.01)

(56) References Cited

U.S. PATENT DOCUMENTS

| | | | | |
|---|---|---|---|---|
| 5,322,489 | A | 6/1994 | Webb et al. | |
| 6,508,743 | B1 | 1/2003 | Fortin | |
| 6,579,213 | B1 * | 6/2003 | Webber et al. | 482/100 |
| 6,702,724 | B2 * | 3/2004 | Taylor et al. | 482/101 |
| 7,108,636 | B1 | 9/2006 | Garcia | |
| 7,335,140 | B2 | 2/2008 | Webber et al. | |
| 7,361,125 | B2 | 4/2008 | Webber et al. | |
| 7,566,292 | B1 | 7/2009 | Hauser et al. | |
| 7,806,813 | B2 | 10/2010 | Campitelli | |
| 2007/0232464 | A1 | 10/2007 | Chu | |
| 2008/0039297 | A1 | 2/2008 | Steinmetz | |
| 2009/0258761 | A1 * | 10/2009 | Quinn | 482/41 |
| 2011/0028280 | A1 * | 2/2011 | Adams | 482/94 |

OTHER PUBLICATIONS

The International Search Report and Written Opinion for related PCT Application No. PCT/US2012/042740 mailed on Feb. 28, 2013 in 9 pages.

* cited by examiner

ASSISTED CHIN/DIP EXERCISE APPARATUS WITH ADJUSTABLE CHIN-UP/PULL-UP HANDLES

CROSS-REFERENCE TO RELATED APPLICATIONS

The application is a divisional of U.S. patent application Ser. No. 13/493,205, which was filed in the U.S. Patent and Trademark Office on Jun. 11, 2012. Application Ser. No. 13/493,205 claims the benefit of provisional U.S. Patent Application Ser. No. 61/500,384, which was filed in the U.S. Patent and Trademark Office on Jun. 23, 2011. This application claims priority to each of the aforementioned applications, which are incorporated herein by reference.

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There have been no joint research agreements entered into with any third parties.

FIELD OF THE INVENTION

This invention relates generally to an assisted chin/dip exercise apparatus for performing chin-up, pull-up and dip exercises, and is particularly concerned with handle arrangements for such an apparatus.

BACKGROUND OF THE INVENTION

Chin-ups, pull-ups, and dips are strength training exercises in which an exerciser lifts their entire body weight. In a chin-up exercise, an exerciser grasps an overhead bar and raises himself or herself to a raised position with their chin in substantially the same vertical position as their hands. A pull-up exercise is similar to a chin-up apart from the hand position. Generally, the palms of the hands face towards the face in a chin-up exercise, while the palms face outward or towards one another for a pull-up. In a dip exercise, the exerciser supports their hanging body on a pair of parallel handles with their arms straight and extending down along their sides. The exerciser then bends their arms at the elbow and lowers their body, then pushes their body straight up by straightening their arms.

Both chin-up and dip exercises are very difficult for the average person to do without assistance. Various types of chin/dip exercise equipment are known for assisting people in performing such exercises. One example of such equipment is the assisted dip/chin exercise device described in U.S. Pat. No. 5,011,139 of Towley. Dedicated chin/dip exercise equipment generally has an upright frame with overhead handles for chin-ups and pull-ups and a lower pair of parallel handles for dips, as well as a pivotal assist or foot bar connected to a weight stack through a cable and pulley system which can apply a pre-adjusted force to assist an exerciser in performing the exercise. One problem with such equipment is that the exerciser may hit their head on the overhead chin-up handles when stepping onto the raised assist bar or when performing dip exercises.

SUMMARY OF THE INVENTION

In one aspect, an assisted chin/dip exercise apparatus has a main frame having a foot bar pivotally mounted on the frame and configured for assisting a user during performance of chin and dip exercises. The main frame has a pair of spaced overhead supports having inwardly directed first and second pivot mounts, and first and second adjustable handles are pivotally mounted on the respective first and second pivot mounts for movement between first and second end positions. In the second end position, the handles are spaced apart to leave a gap between the handles which is of sufficient width to provide clearance for the head of a user when they step up onto the foot bar or platform or when performing a dip exercise.

In one embodiment, the handles are angled inwardly and rearwardly towards one another in the first position and extend forward and generally parallel to one another in the second position. In the first position, the handles are oriented for gripping by a user when performing a chin-up exercise. In the second position, the handles may be gripped by a user to perform a pullup exercise. If the handles are oriented in the second position while a user performs a dip exercise, clearance is provided between the handles for the user's head when the user moves their upper body upwards during the exercise. The handles are freely pivotable between the first and second positions. If the user forgets to move the handles from the first position, their head simply pushes the handles up out of the way as they push upwards, reducing or eliminating the risk of injury.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
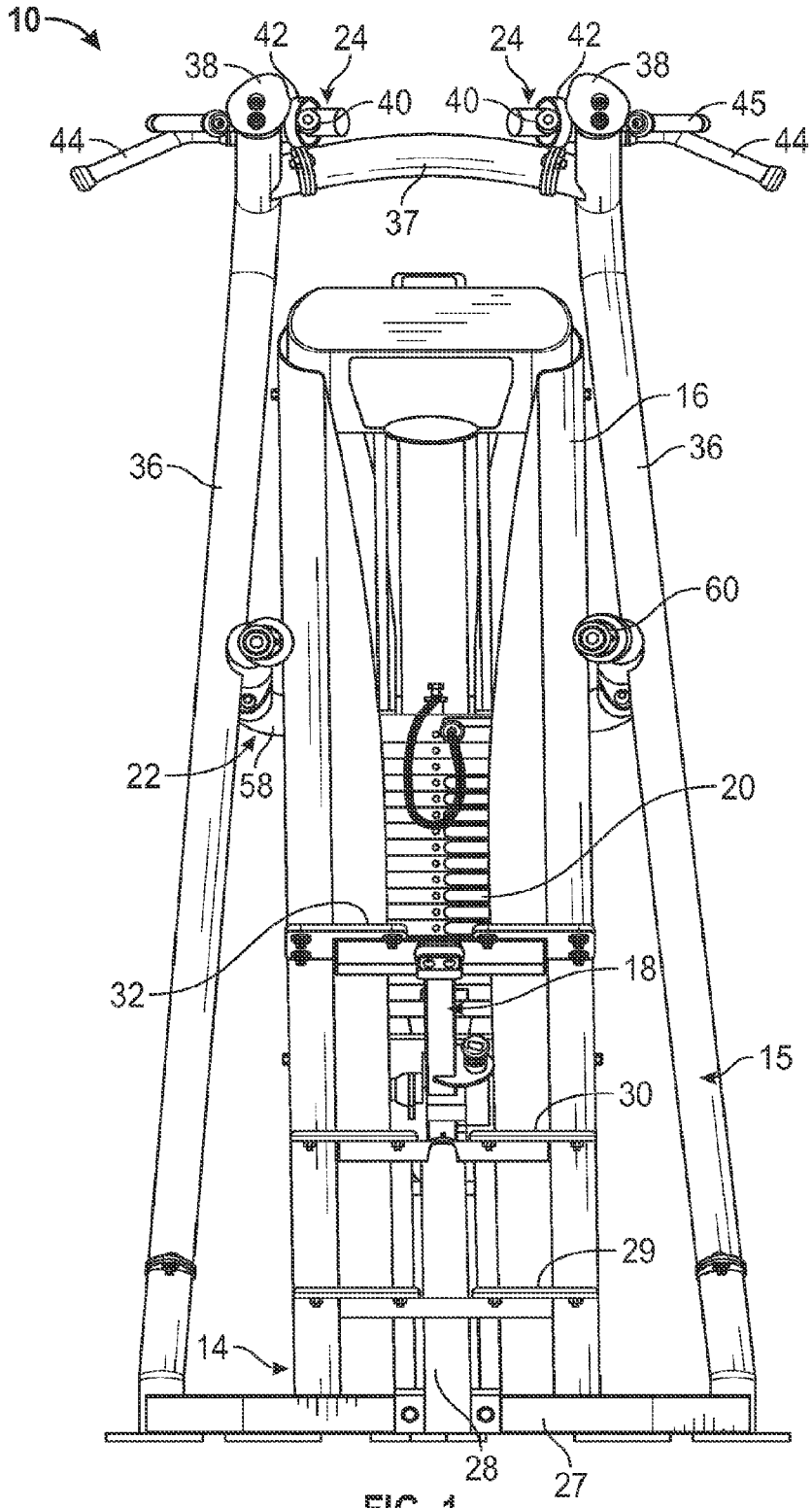
FIG. 1 is a front elevation view of one embodiment of an assisted chin/dip exercise apparatus having adjustable overhead handles.

Certain embodiments as disclosed herein provide for an assisted chin/dip exercise apparatus with a pair of adjustable overhead handles which can be pivoted between two end positions, one of which provides clearance for a user's head when stepping onto the apparatus or when performing dip exercises.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 12 illustrate one embodiment of an assisted chin/dip exercise apparatus 10 with adjustable overhead handles. Although the exercise apparatus is a stand-alone chin/dip machine with adjustable handles in the illustrated embodiment, it may alternatively be part of an exercise machine with multiple exercise stations or may be secured to a wall or other fixed member. As best illustrated in FIGS. 1 to 6, the apparatus or machine 10 basically comprises a stationary frame having a base portion 14, an upright portion 15, and an overhead portion 17, a weight stack housing 16, a pivotally mounted foot or assist bar 18 which is connected to a selectorized weight stack 20 in housing 16 in a conventional manner via a cable and pulley system (not visible in the drawings), a dip handle assembly 22 secured to the upright frame portion 15 and housing 16 at a location spaced above foot bar 18, and an adjustable overhead handle assembly 24 secured to overhead support portion 17 above dip handle assembly 22. Adjustable handle assembly 24 may be positioned for gripping by a user while performing chin-up or pull-up exercises, as described in more detail below.

Figure 2:
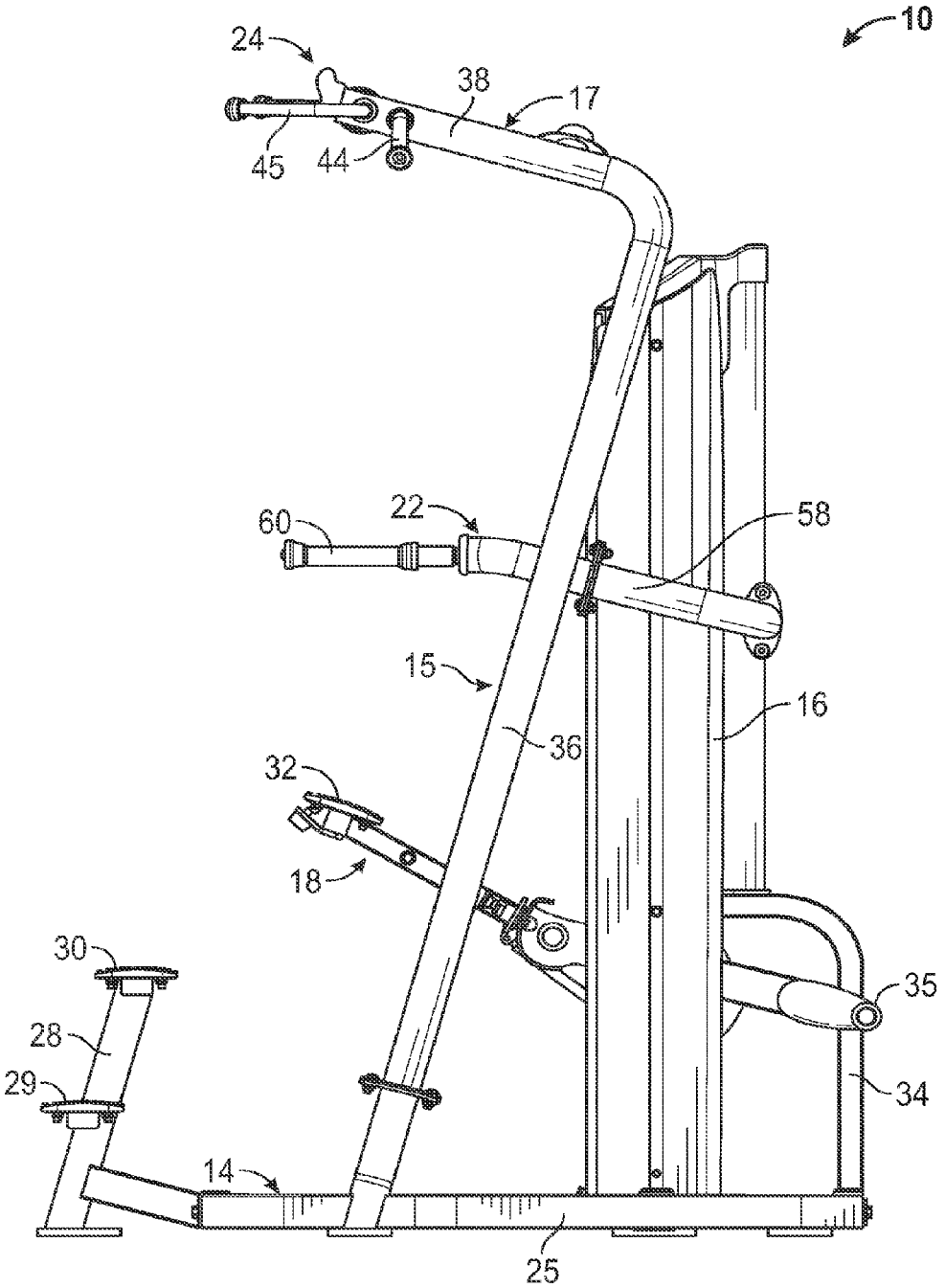
FIG. 2 is a side elevation view of the apparatus of FIG. 1.
Figure 3A:
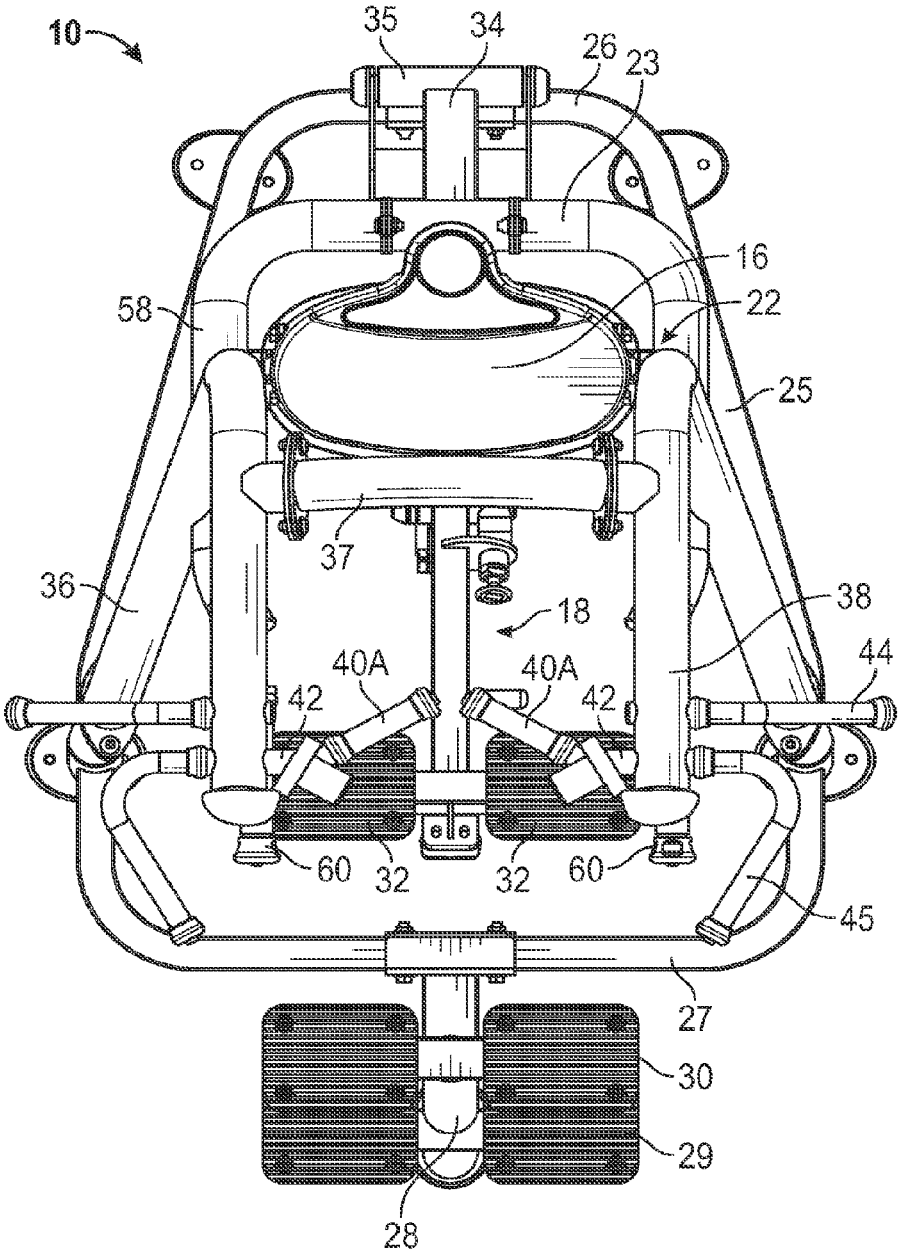
FIG. 3A is a top plan view of the apparatus of FIGS. 1 and 2 with the adjustable overhead handles in a first position.
Figure 3B:
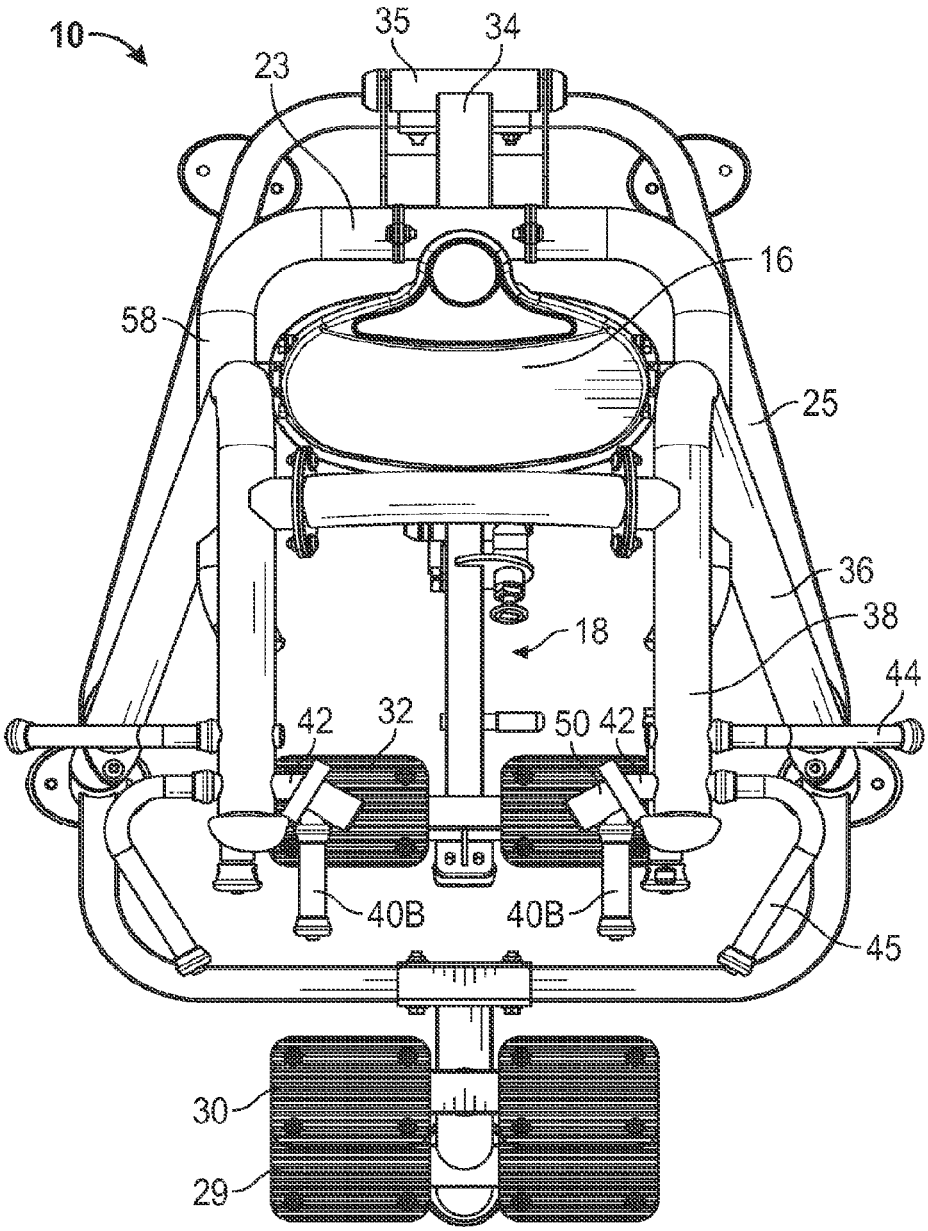
FIG. 3B is a top plan view of the apparatus as in FIG. 3A but with the adjustable handles in a second position.

The base or floor engaging portion 14 of the frame has a rear strut 26, a pair of side struts 25 extending forward from rear strut 26 on opposite sides of the frame, and a front strut 27 extending between the forward ends of struts 25. A central upright 28 extends upward from strut 27 at a forward end of the frame, and a pair of steps 29, 30 are mounted on upright 28 to assist the exerciser in stepping onto foot supports or foot platform 32 mounted on the front end of foot bar 18. A rear upright 34 extends upward from rear strut 26 and a rear end of foot or assist bar 18 is pivotally mounted on rear upright 34 via pivot mount 35, as best illustrated in FIGS. 3A and 3B. The foot bar 18 includes a conventional range of motion (ROM) adjustment mechanism for adjusting the foot plate position. FIGS. 1 and 2 illustrate the foot plates 32 in a raised position prior to a user stepping onto the plates, due to the positive or upward biasing force of the weights in weight stack 20 which are linked to the foot bar 18. A user can select the amount of biasing force or assist desired before starting an exercise.

Upright portion 15 of the frame includes a pair of struts 36 which extend generally upwards from the respective side struts and are inclined rearwards. The overhead portion 17 comprises overhead supports 38 extending forward from the upper ends of respective struts 36. A cross bar 37 extends between overhead supports 38.

Dip handle bar 22 is generally U-shaped and has a rear portion 23 secured to the rear of the weight stack housing 16 and a pair of arm portions 58 which project forwards on opposite sides of the housing and are each secured to the respective upright struts 36 at an intermediate point in their length, with forwardly extending hand grips 60 projecting from the forward ends of the respective arm portions 58.

Figure 3C:
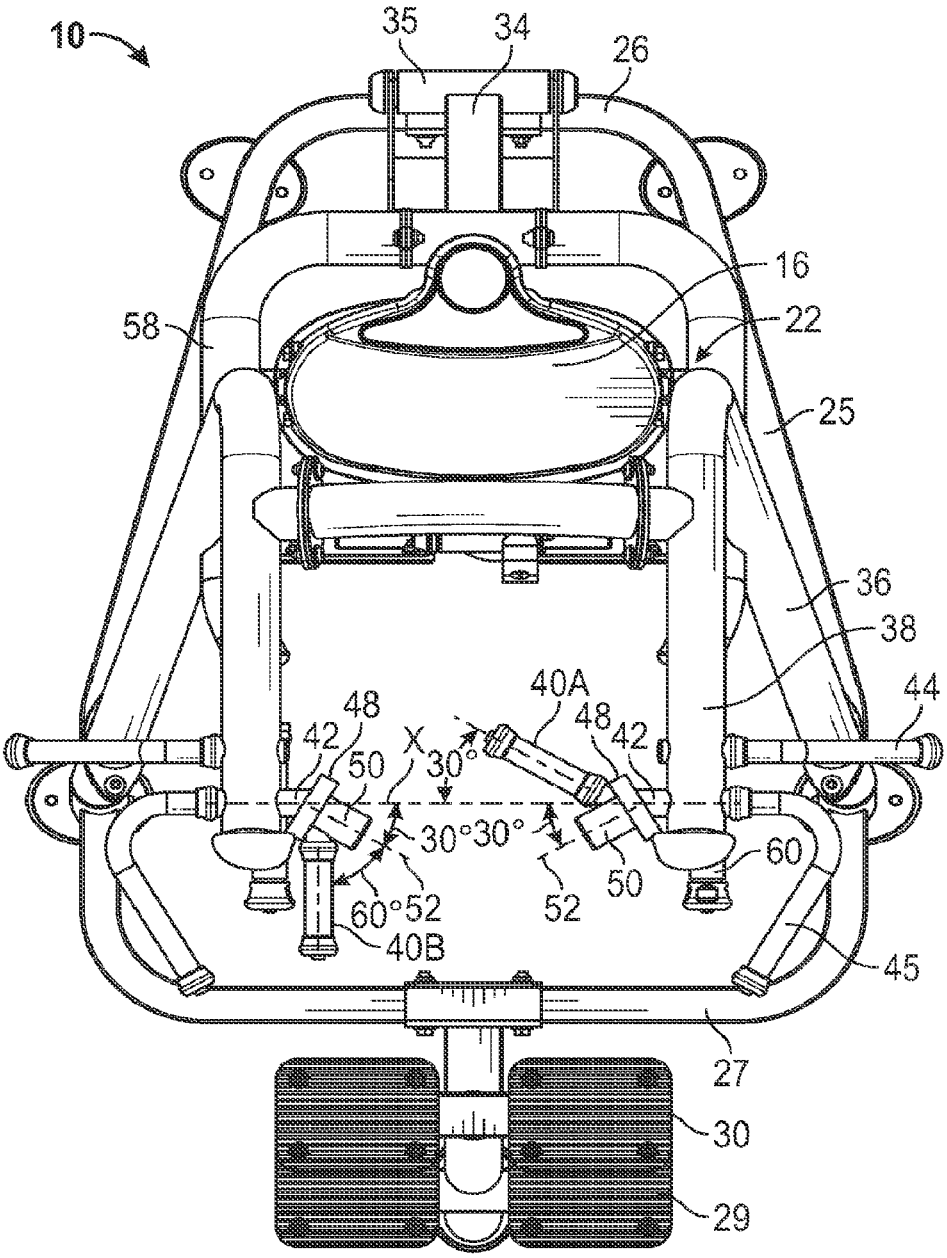
FIG. 3C is a top plan view of the apparatus as in FIGS. 3A and 3B but with the movable foot or assist bar folded out of the way in an inoperative position, and with one of the handles in the first position and the other adjustable handle in the second position.

The adjustable chin/pull-up handle assembly 24 comprises a pair of adjustable handles or hand grips 40 each associated with a pivot portion or pivot sleeve 50. The handles are adjustably mounted on respective pivot mounts 42 on the inner sides of the respective overhead supports 38 via pivot portion 50, as best illustrated in FIG. 3A to 7B. Handle or hand grip 40 extends at an angle to the pivot mount, as described in more detail below. FIGS. 3A and 3B illustrate the handles 40 in first end position 40A (chin-up position) and second end position 40B (pull-up position), respectively, while FIG. 3C illustrates one handle in the first end position 40A and the other in the second end position 40B, with the foot plates 32 moved into an inoperative position in this figure. Additional fixed handles or rock-climbing grips 44, 45 are provided on the outer side of each overhead support 38 to provide different gripping positions for varying a pull-up exercise. Handles 44 extend outwards in opposite directions from the outer sides of supports 48, while handles 45 have forwardly extending, inwardly angled gripping portions (see FIGS. 1 to 3A).

Figure 7A:
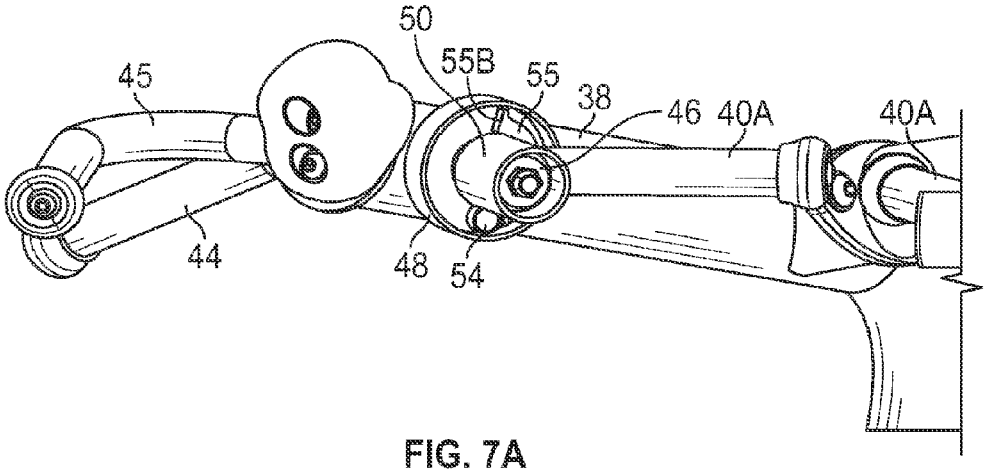
FIG. 7A is a side elevation view of one adjustable handle assembly with the protective cover removed to illustrate the stop mechanism, with the handle in the first position.
Figure 7B:
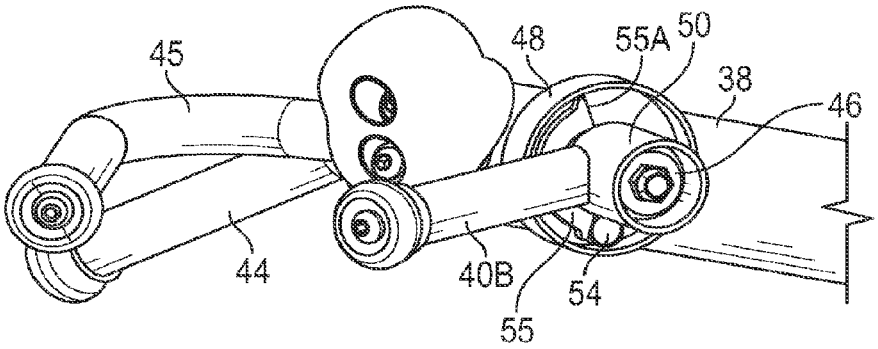
FIG. 7B is a side elevation view similar to FIG. 7A but illustrated the handle rotated into the second position with the rotating stop engaging the opposite side of the stop pin.
Figure 8A:
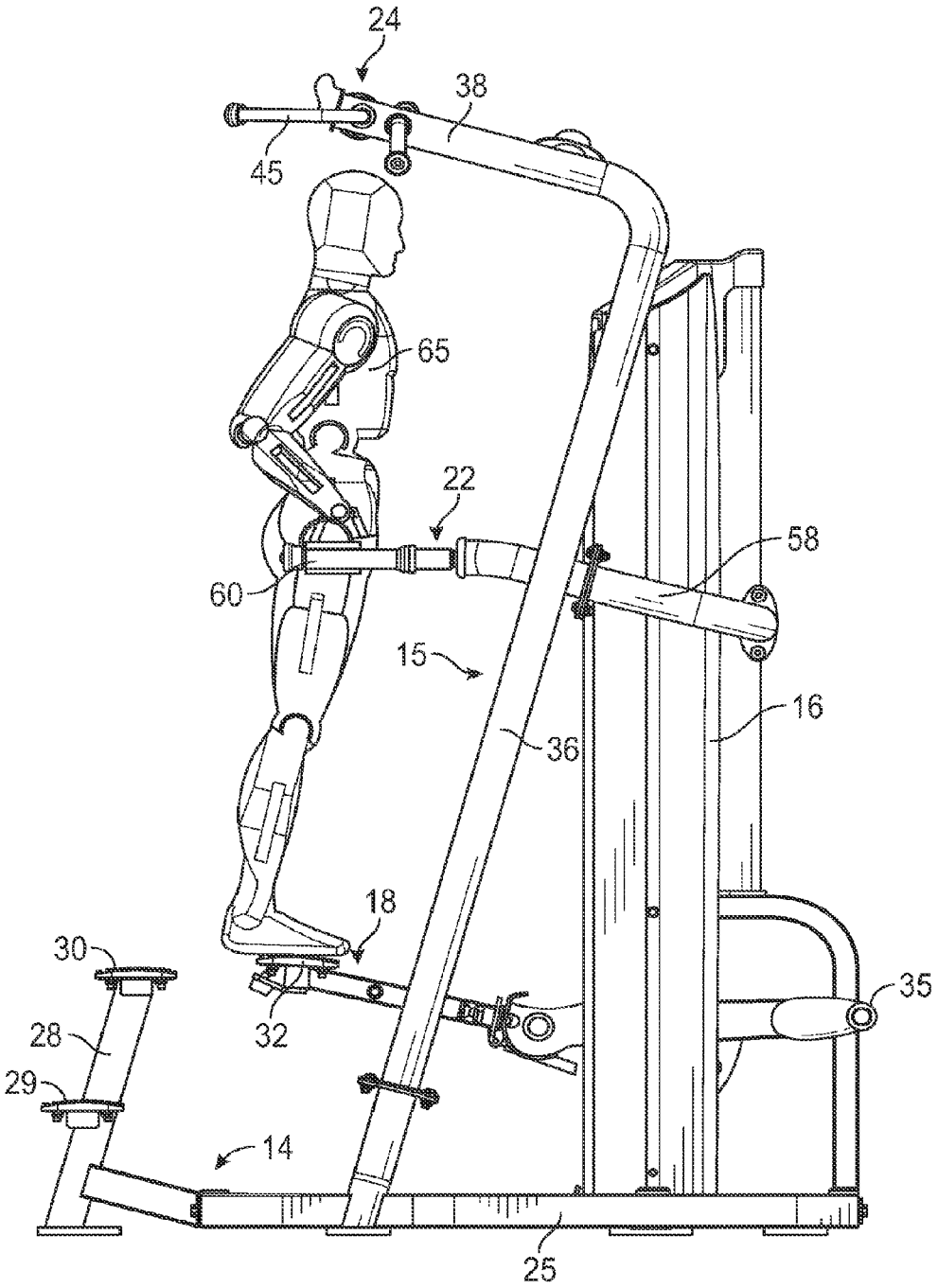
FIG. 8A is a side elevation view of the apparatus of FIGS. 1 to 7B illustrating an exerciser in position and ready to perform a dip exercise.
Figure 8B:
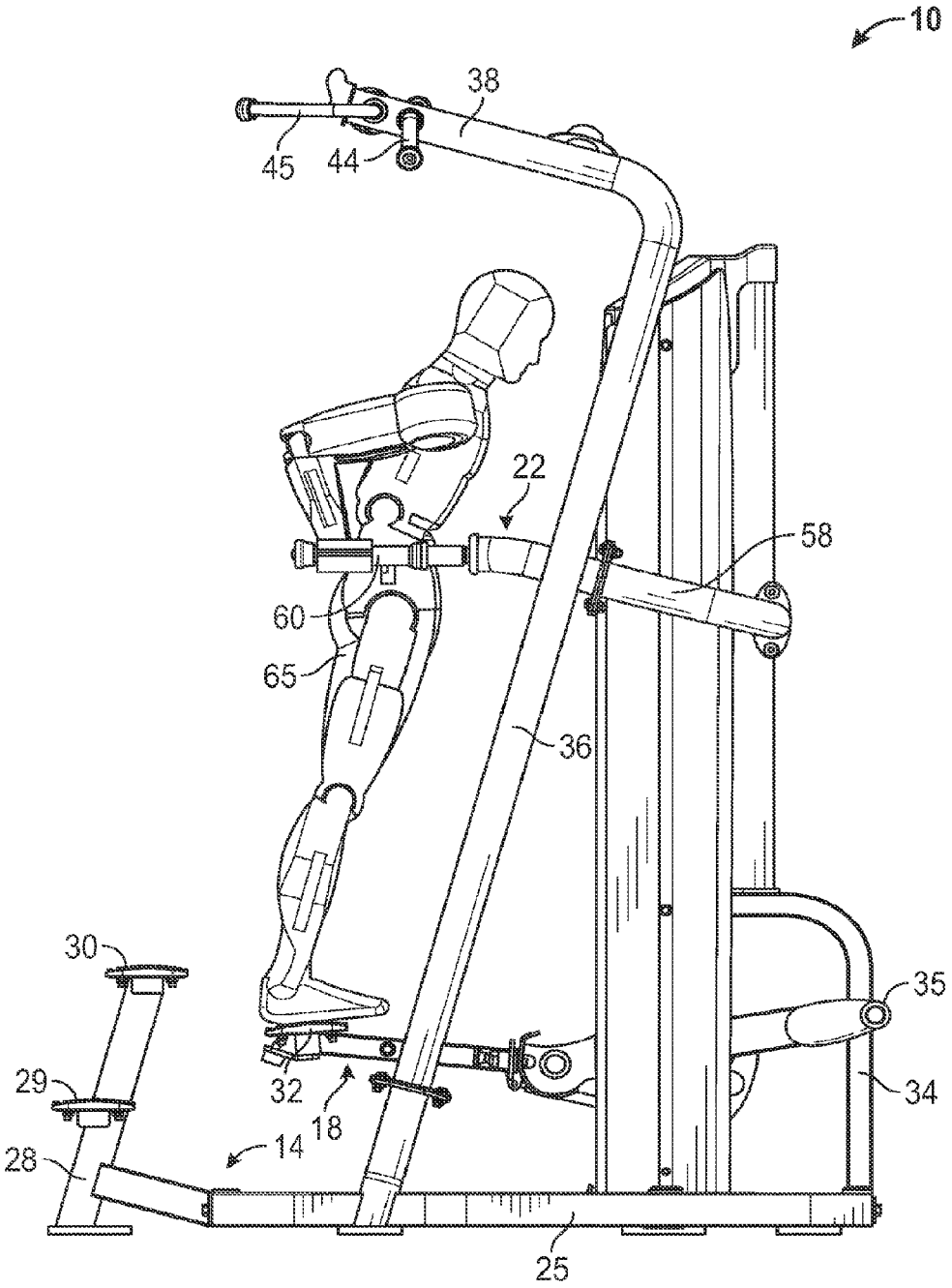
FIG. 8B is a side elevation view of the apparatus as in FIG. 8A but with the user in a different, raised position during the dip exercise.

Each pivot mount 42 has a first part extending transversely inward from the respective support 38 in alignment with the corresponding inner part of the other pivot mount along transverse axis, and a pivot pin 46 extending at a forward angle of around 30 degrees from the first part of pivot mount 42 to define handle pivot axis 52. Annular housing 48 surrounds an inner end of pin 46 and a stop mechanism which defines the handle end positions, as illustrated in FIGS. 7A and 7B and described in more detail below. The pivot axes 52 of the pivotally mounted handles are angled inwardly towards one another and at a forward angle of around 30 degrees to transverse axis X of FIG. 3C (a horizontal axis extending transverse to the central longitudinal axis of the exercise machine frame). The pivot axes may be oriented at different angles in alternative embodiments, and may be at forward angles in the range from 20 degrees to 40 degrees to axis X in alternative embodiments.

In the illustrated embodiment, the pivot portion of each handle comprises a pivot sleeve 50 rotatably mounted on a respective pivot pin 46, and handle or hand grip 40 extends from the pivot sleeve at a predetermined angle to the respective pivot axis. In one embodiment, the angle may be in the range from about 50 degrees to 70 degrees to the pivot axis, and in the illustrated example this angle is around 60 degrees to the pivot axis 52, as illustrated in FIG. 3C. The handles are freely rotatable back and forth about pivot axis 52 between rearwardly angled chin-up position 40A and forwardly extending pull-up position 40B, as defined by end stops of the stop mechanism which is described in more detail below. The hand grips may be oriented horizontally or substantially horizontally in both end positions 40A and 40B.

As illustrated in FIGS. 4, 5, 10 and 12, a guard plate or cover 49 is welded or otherwise secured over the front of guard or housing 48. The cover 49 is removed in FIGS. 7A and 7B to illustrate the stop mechanism which defines the handle end positions. The cover plate keeps fingers out of the mechanism so that they do not become pinched or trapped. Sleeve 50 extends with clearance through central opening in guard plate 49.

As illustrated in FIGS. 7A and 7B, a stop pin 54 is mounted inside housing 48 and a rotating stop 55 secured to sleeve 50 has a first end 55A which engages one side of the stop pin when the handle is in the chin-up position 40A, as seen in FIG. 7A, and a second end 55B which engages the opposite side of stop pin 54 when the handle is in the pull-up position 40B, as seen in FIG. 7B, limiting the rotation of the handle to rotation between these two positions. In one embodiment, the end stops are configured so that the hand grips 40 are horizontal in each end position with the handles rotating through around 180 degrees between the end stop positions. In alternative embodiments, the angle of rotation may be more or less than 180 degrees and one or both end portions may be non-horizontal, depending on the desired hand grip positions. The hand grips extend in the forward direction and parallel to one another in the pull-up position 40B, and are angled rearward and inwardly towards one another at around 30 degrees to the transverse direction X in the chin-up position 40A. Chin-up position 40A of the hand grip is at angle of around 120 degrees to the pull-up position 40B.

In FIG. 3A, both hand grips are positioned in end position 40A, extending inward and rearward at an angle of about 30 degrees to transverse direction X and 60 degrees to the respective support 38 (see right hand hand grip position of FIG. 3C). As illustrated, the inner ends of the handles are very close together in this position. In FIG. 3B, both hand grips are positioned in end position 40B, extending in a forward direction and parallel to one another so as to leave a relatively large gap between the handles. The handles may be placed in this position for performing pull-up exercises, and also while performing dip exercises gripping dip bar handles 60, to provide clearance for the user's head when raising their body to a straight arm position, as described below.

Figure 4:
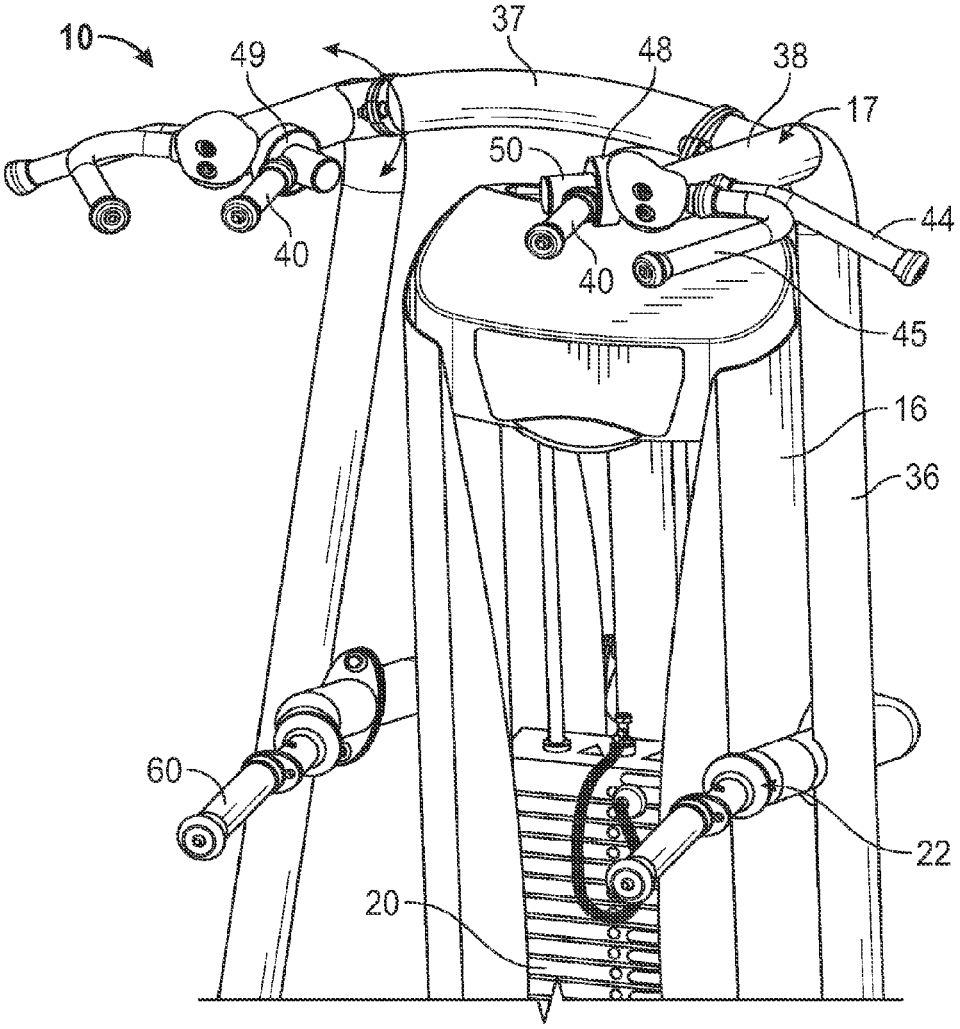
FIG. 4 is a front perspective view of the upper part of the apparatus of FIGS. 1 to 3C, illustrating the handles in the second position of FIG. 3B.
Figure 5:
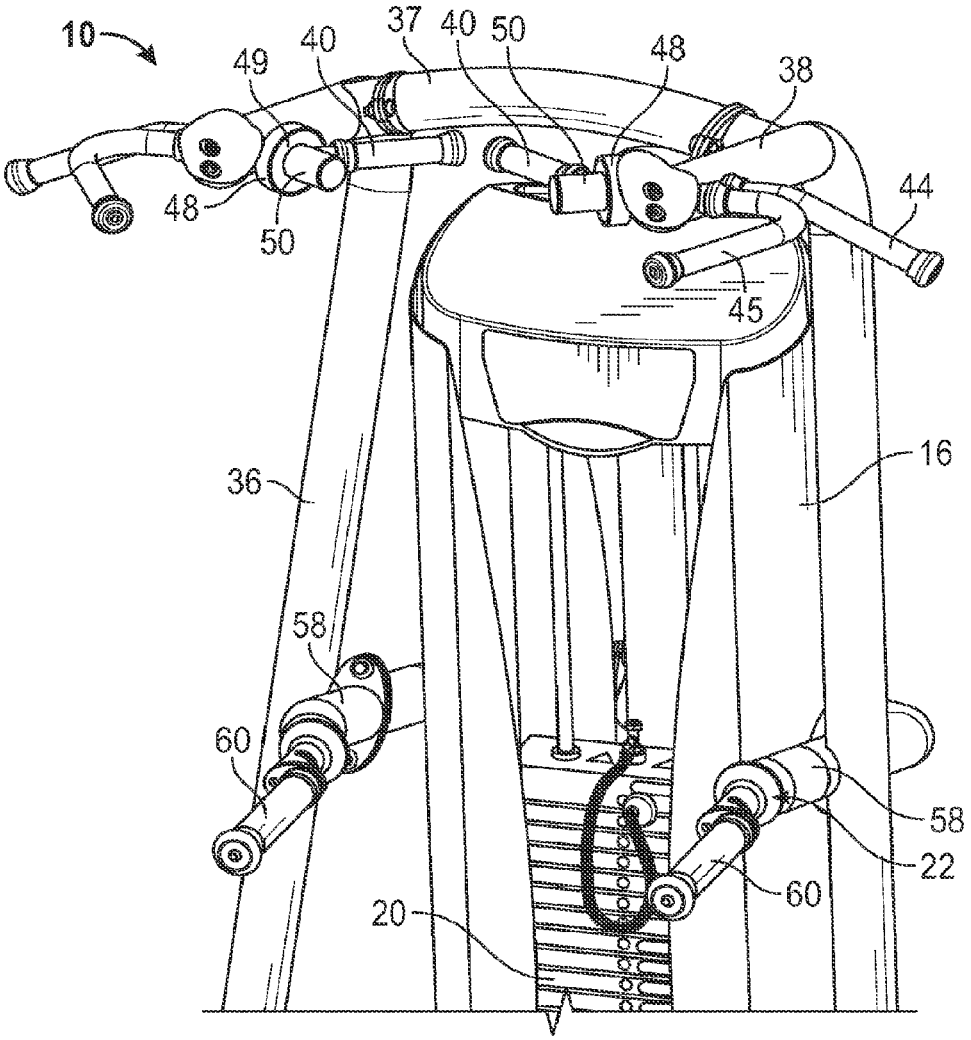
FIG. 5 is a front perspective view similar to FIG. 4 illustrating the handles in the first position of FIG. 3A.
Figure 6:
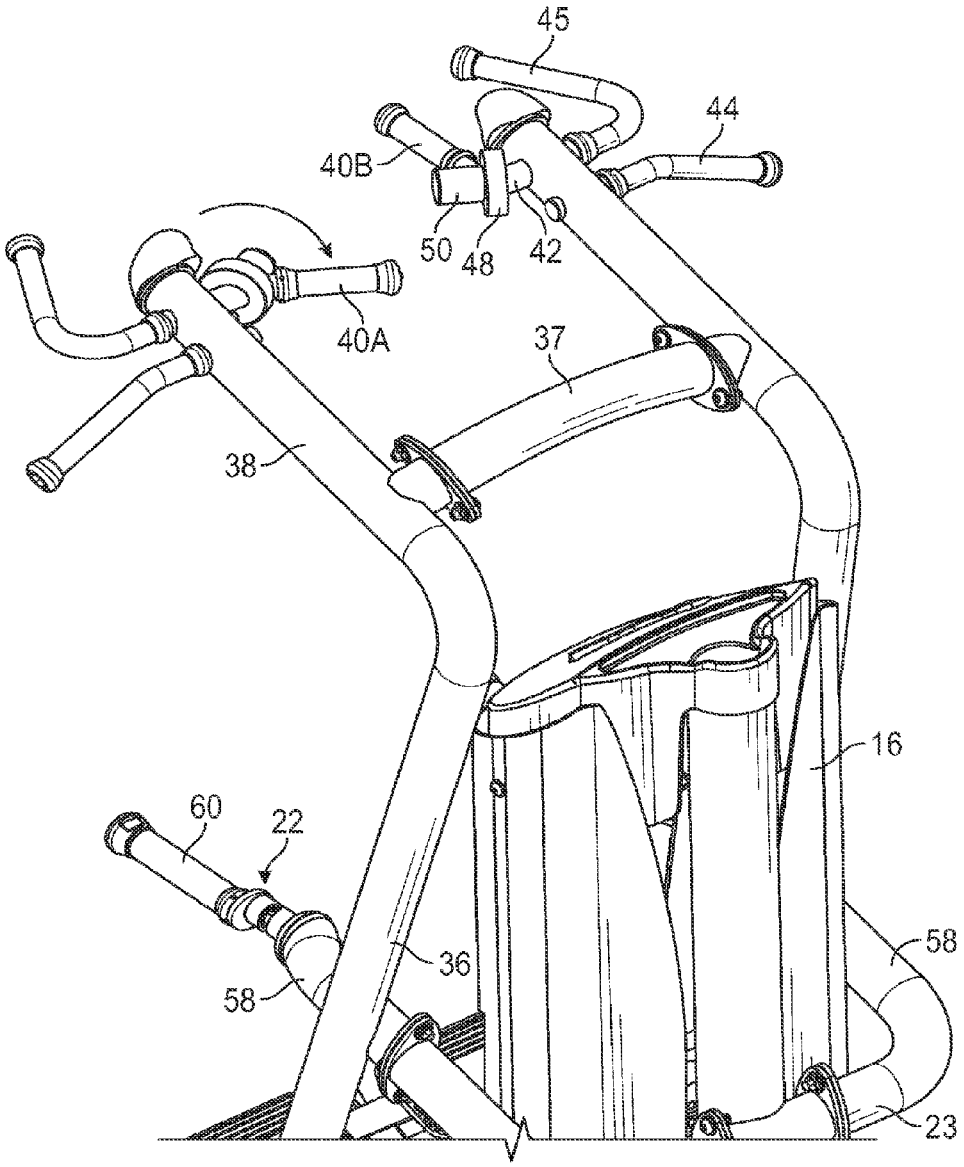
FIG. 6 is a rear perspective view of the upper part of the apparatus illustrating one handle in the first position and the other handle in the second position.

FIGS. 8A to 12 illustrate a user 65 performing dip exercises, chin-up exercises, and pull-up exercises, respectively, on the exercise apparatus 10. At the start of an exercise, the user first selects the desired assistance weight on the weight stack. For a dip exercise, the user rotates the dip hand grips 60 into a narrow or wide position as provided by a conventional adjustment mechanism. The overhead handles are also rotated outward into the second position 40B to provide overhead head clearance between the handles directly above foot bar 18, as illustrated in FIGS. 1, 3B and 4. The user then steps onto the foot platform or plates 32 using steps 29 and 30. Since the overhead handles are pivoted outward in position 40B, the user's head can pass freely between them when stepping up onto the platform. The platform then sinks down under the user' weight into a lower position as in FIG. 8A, and the user grips the handles 60 of the dip handle assembly 22 with their arms bent rearward. They then push their body upwards from the position of FIG. 8A to the position of FIG. 8B, straightening the arms, while the foot platform provides a positive upward force to assist the user in performing the dip exercise. The gap between the hand grips in the position 40B also provides clearance for the user's head as the body is pushed upward. Even if the user forgets to rotate the handles from position 40A before performing this exercise, their head simply contacts the hand grips and pushes them up out of the way, since they are freely rotatable upward and forward about pivot axis 52 from position 40A towards position 40B. Thus, the risk of injury to the head is reduced or eliminated.

Figure 9:
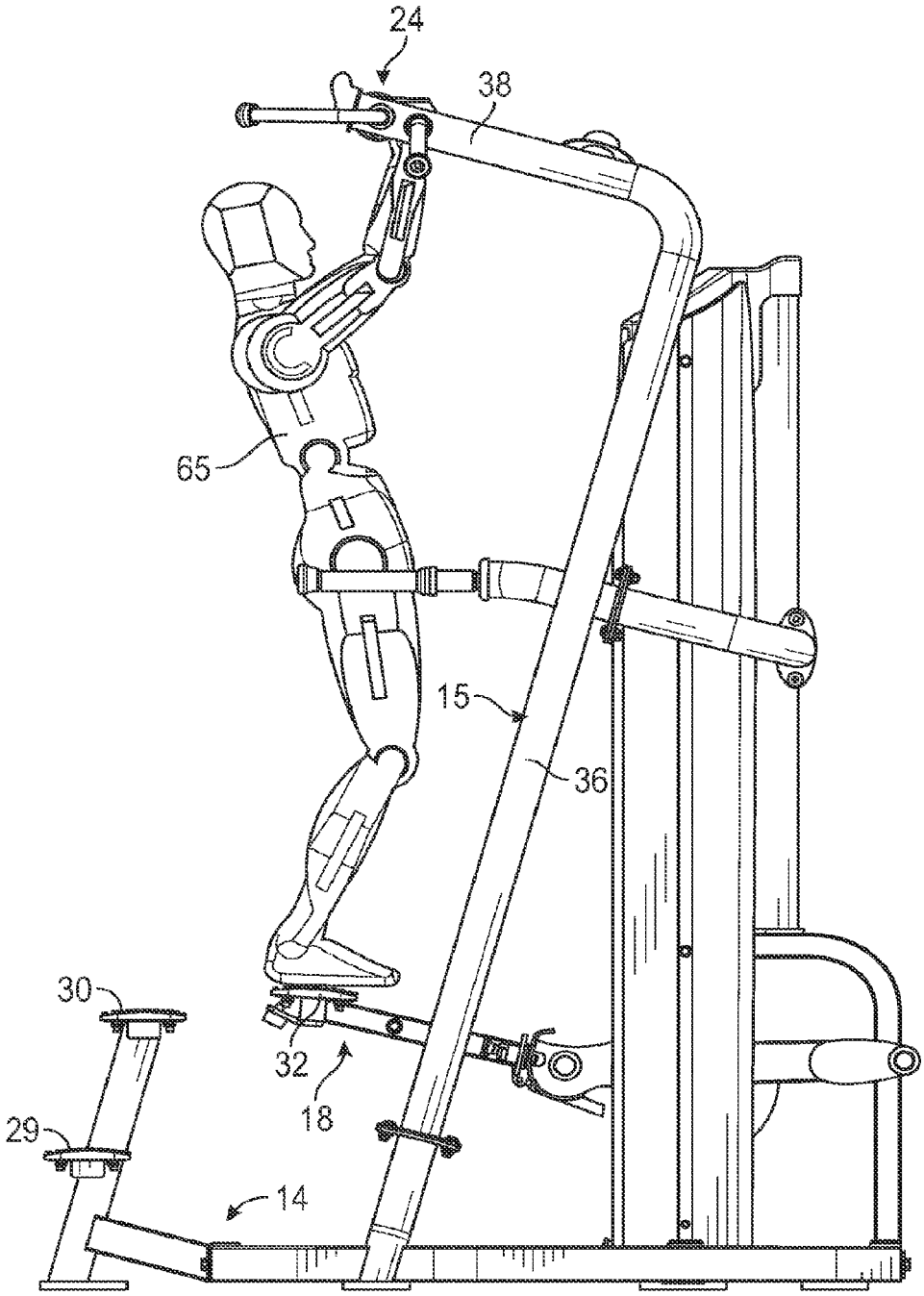
FIG. 9 is a side elevation view similar to FIGS. 8A and 8B but illustrating the user gripping the overhead handles at the start of a chin-up exercise.
Figure 10:
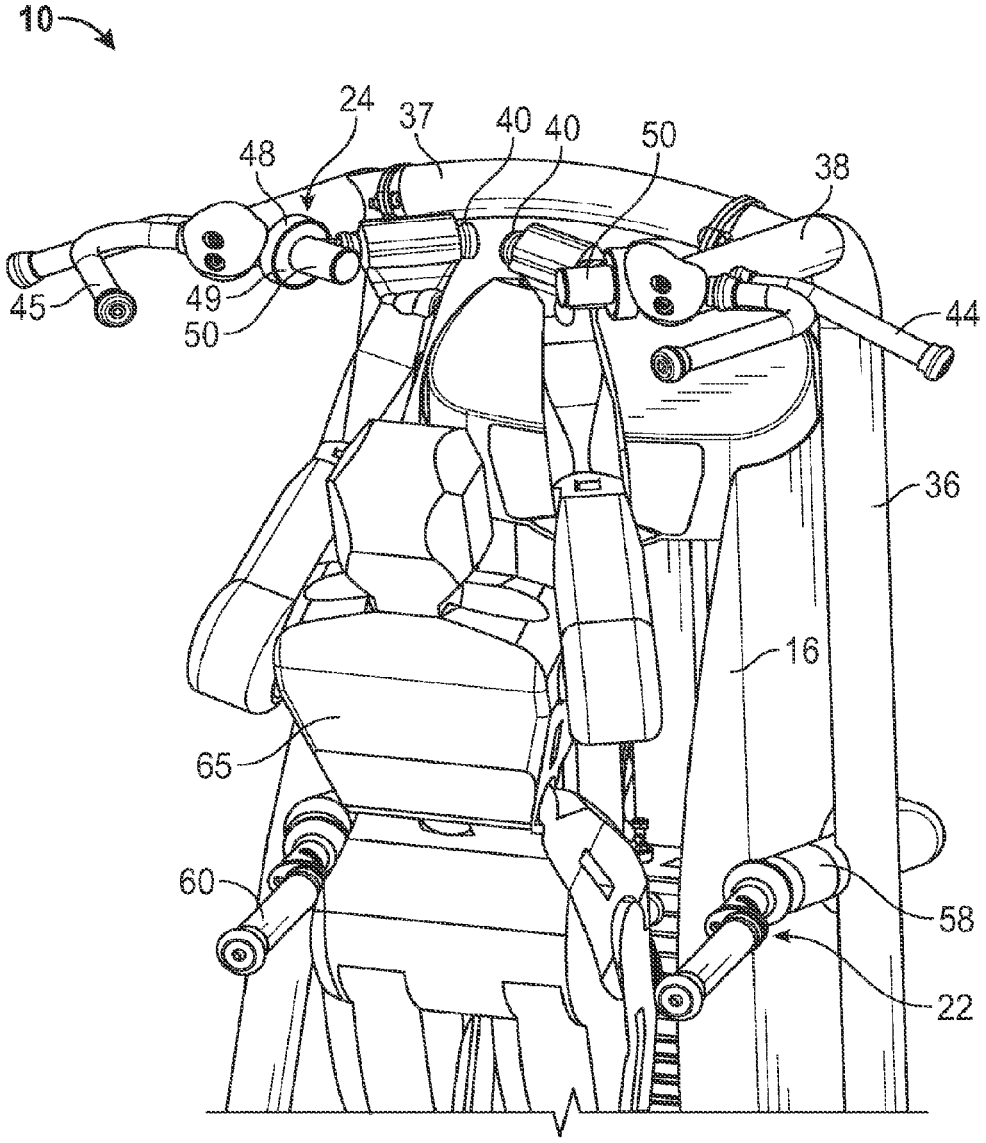
FIG. 10 is an enlarged, front perspective view of the upper part of the machine with the user gripping the overhead handles in the first position while performing the chin-up exercise.

FIG. 9 illustrates the start position for a chin-up exercise, while FIG. 10 illustrates the hand grip position for this exercise in more detail. For a chin-up exercise, the user rotates the handles inward into position 40A, and then grasps the hand grips with their palms facing inward towards their face as in FIG. 10. The user then steps up onto the platform and performs chin-up exercises in the normal manner, with foot bar assembly 18 providing a positive assist as the user pulls up their body until their chin is level with their hands.

Figure 11:
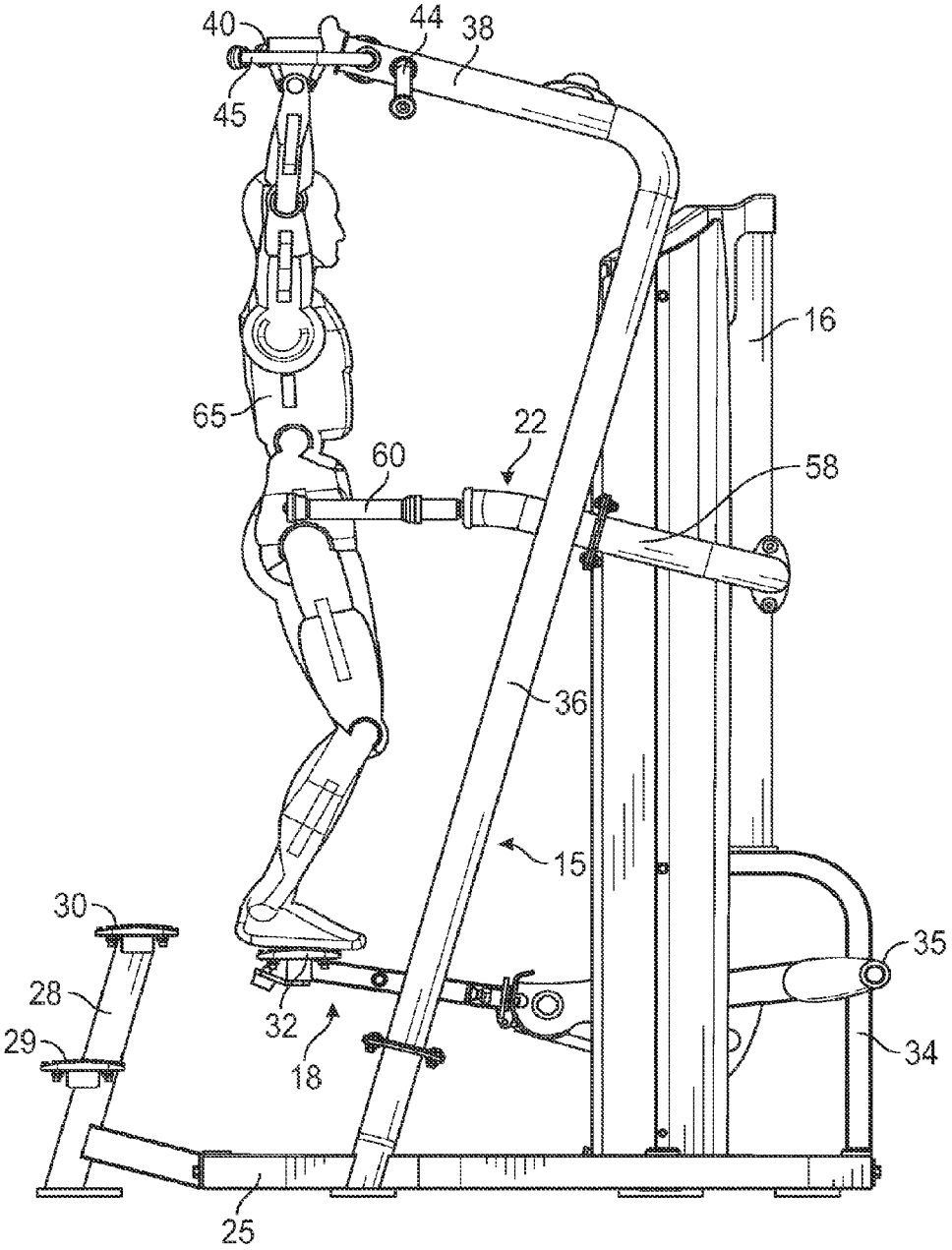
FIG. 11 is a side elevation view similar to FIG. 9 but illustrating the user at the start of a pull-up exercise, with the adjustable overhead handles in the second position.
Figure 12:
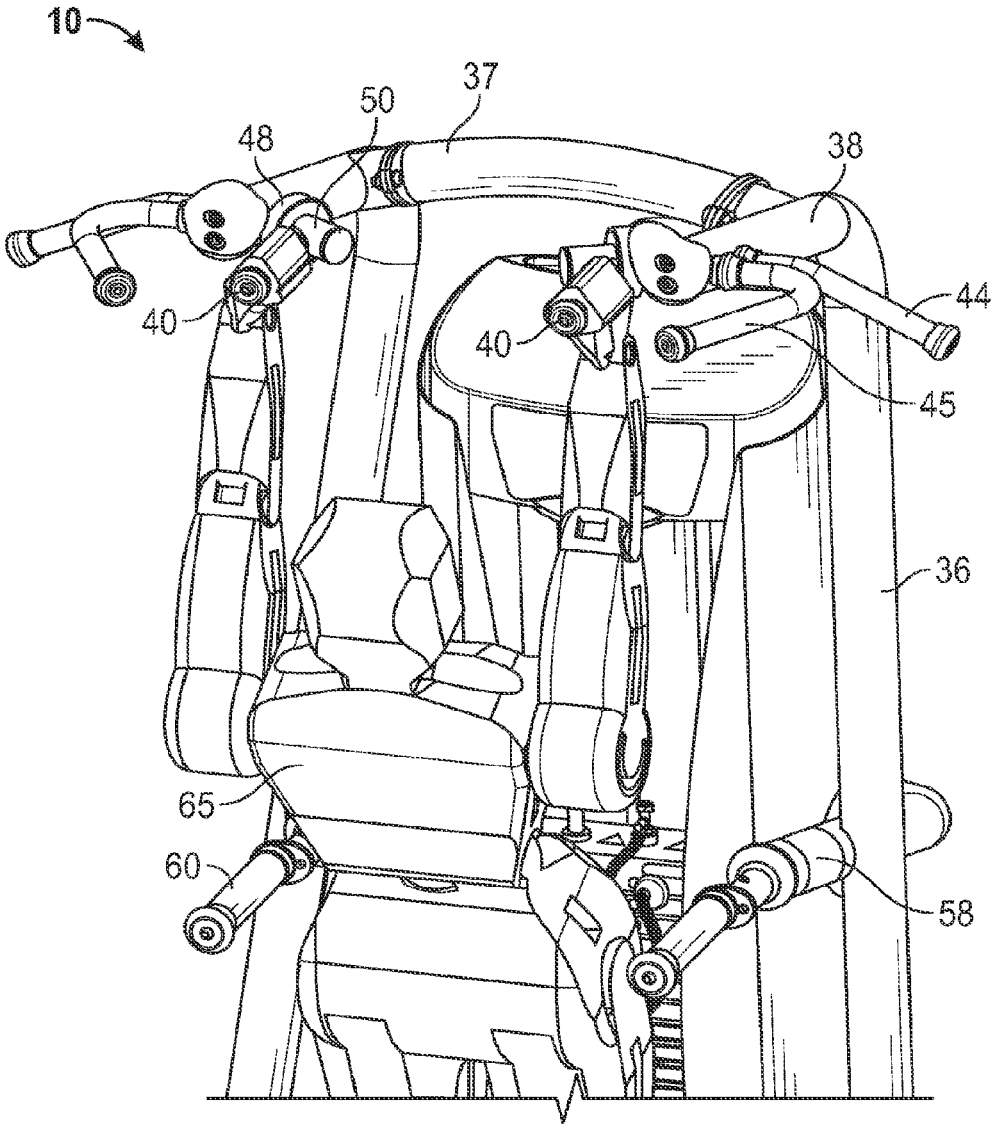
FIG. 12 is an enlarged, front perspective view similar to FIG. 10 but with the user gripping the handles as in FIG. 11 during a pull-up exercise.

FIGS. 11 and 12 illustrate the adjustable handle and hand position for a pull-up exercise. In this exercise, the handles are rotated into the pull-up position 40B. The rock climbing grips or handles 44 or 45 may alternatively be gripped while performing pull-up exercises to provide different grip positions and vary the exercise. FIGS. 11 and 12 illustrate the user 65 preparing to perform a pull-up exercise after stepping onto the foot plate 32 of assist bar 18 and gripping the adjustable handles or hand grips in the pull-up position 40B, with the palms facing inwards towards one another. They may alternatively grip the handles with their palms facing outwards. Once the handles are gripped, the user lifts or pulls up their body until their chin is level with their hands, with foot bar assembly 18 assisting the exercise. Since there are no separate, fixed chin-up handles, there is no risk of the user's head hitting any such handles while performing such exercises.

For an un-assisted dip, chin-up or pull-up exercise, the foot platform or plates 32 may be folded down out of the way in the normal manner.

The rotating chin-up/pull-up handles allow a greater range of different hand grip positions while also permitting free rotation of the handles from inwardly extending, rearwardly angled chin-up grip positions to forwardly projecting, parallel pull-up grip positions. This avoids or reduces the risk of a user hitting fixed, rigid chin-up handles with their head as they step up onto the movable assist bar or foot platform, or while they are lifting their body when performing a dip or pull-up exercise with their head directly under the overhead handle assembly.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

We claim:

1. An exercise apparatus, comprising:

a main frame comprising a base portion, an upright portion, and an overhead portion;

an assist bar comprising a foot platform that is pivotally mounted on the main frame and configured to assist a user during performance of exercises on the apparatus; and an overhead handle assembly secured to the overhead portion of the main frame and comprising a plurality of handle pairs, the plurality of handle pairs comprising a pair of adjustable handles that are adjustable between a first position extending away from the exercise apparatus and a second position extending inwardly and towards the main frame of the exercise apparatus, wherein the pair of adjustable handles are acutely angled, relative to a horizontal axis extending transverse to a central longitudinal axis of the main frame, inwardly towards one another in the first position and perpendicularly angled, relative to the horizontal axis extending transverse to the central longitudinal axis of the main frame, rearwardly towards a rear end of the frame in the second position.

2. The apparatus of claim 1, further comprising a dip handle assembly secured to the upright portion of the frame between the assist bar and the overhead portion, the dip handle assembly comprising hand grips configured for gripping by a user while performing dip exercises.

3. The apparatus of claim 1, wherein the first position comprises a pull-up position in which the pair of adjustable handles are oriented for gripping by a user while performing a pull-up exercise and the second position comprises a chin-up position in which the pair of adjustable handles are oriented for gripping by a user while performing a chin-up exercise.

4. The apparatus of claim 1, wherein the pair of adjustable handles extend away from the rear end of the frame and substantially parallel to one another in the first position.

5. The apparatus of claim 1, wherein the pair of adjustable handles are configured to rotate upwardly from the first position towards the second position or from the second position towards the first position.

6. The apparatus of claim 1, further comprising a weight stack assembly linked to the assist bar for urging the foot platform of the assist bar upwardly towards the overhead handle assembly.

7. The apparatus of claim 1, wherein the pair of adjustable handles in the first position are oriented for gripping by a user with their palms facing inward towards one another.

8. The apparatus of claim 1, wherein the plurality of handle pairs further comprise a pair of fixed handles secured to the main frame adjacent to the pair of adjustable handles and configured for selective gripping by a user.

9. The apparatus of claim 8, wherein the pair of fixed handles are spaced apart by a distance greater than the pair of adjustable handles in the first position, and are configured to define a different gripping position from the pair of adjustable handles in the first position.

10. The apparatus of claim 9, wherein the pair of fixed handles comprise a fixed right handle and a fixed left handle which extend generally away from one another on opposite sides of the upright frame portion, the fixed right handle and the fixed left handle being configured for gripping by a user's hands with their palms facing generally rearward.

11. The apparatus of claim 10, wherein the plurality of handle pairs further comprise another pair of fixed handles secured to the overhead portion of the frame and spaced forward from the pair of fixed handles, the another pair of fixed handles being configured for selective gripping by a user and spaced apart by a distance greater than the pair of adjustable handles in the first position, wherein the pair of fixed handles and the another pair of fixed handles are at different orientations and are configured for providing different gripping positions for a user.

12. The apparatus of claim 11, wherein the another pair of fixed handles extend generally forward and parallel to one another.

13. An adjustable overhead handle assembly for use with an exercise machine, the adjustable overhead handle assembly comprising:

a left adjustable handle pivotally mounted at a left position of the adjustable overhead handle assembly and configured for rotation about a left pivot axis between respective first and second end positions;

a right adjustable handle pivotally mounted at a right position of the adjustable overhead handle assembly and configured for rotation about a right pivot axis between respective first and second end positions; and left and right pivot mounts defining the respective left and right pivot axes, wherein the left and right adjustable handles are rotatably mounted on the left and right pivot mounts, respectively, and wherein each of the left and right pivot mounts comprises an annular housing surrounding a stop pin and a rotational stop, the rotational stop having a first end and a second end for engaging with the stop pin.

14. The adjustable overhead handle assembly of claim 13, further comprising a frame having a front end, a rear end, and a central longitudinal axis, wherein the left and right pivot axes are non-vertical pivot axes extending generally inwardly towards the central longitudinal axis and angled forwardly towards the front end of the frame.

15. The adjustable overhead handle assembly of claim 13, further comprising:

a first pair of fixed handles secured to the overhead handle assembly adjacent to the pair of adjustable handles and configured for selective gripping by a user; and a second pair of fixed handles secured to the overhead handle assembly adjacent to the pair of adjustable handles and configured for selective gripping by a user.

16. The adjustable overhead handle assembly of claim 15, wherein the first pair of fixed handles are spaced apart by a distance greater than the pair of adjustable handles in the first position and extend generally away from one another on opposite sides of the adjustable overhead handle assembly.

17. The adjustable overhead handle assembly of claim 16, wherein the second pair of fixed handles are spaced apart by a distance greater than the pair of adjustable handles in the first position and extend at an angle towards one another on opposite sides of the adjustable overhead handle assembly.

18. The adjustable overhead handle assembly of claim 17, wherein the second pair of fixed handles are curved handles that extend generally away from one another at a point of attachment with the adjustable overhead handle assembly, and extend at an angle towards one another at respective ends thereof.

19. An adjustable overhead handle assembly for use with an exercise machine, the adjustable overhead handle assembly comprising:

a left adjustable handle pivotally mounted at a left position of the adjustable overhead handle assembly and configured for rotation about a left pivot axis between respective first and second end positions;

a right adjustable handle pivotally mounted at a right position of the adjustable overhead handle assembly and configured for rotation about a right pivot axis between respective first and second end positions;

a first pair of fixed handles secured to the frame adjacent to the pair of adjustable handles and extending generally away from one another on opposite sides of the adjustable overhead handle assembly; and a second pair of fixed handles, each fixed handle having a first end secured to the frame adjacent to the pair of adjustable handles and a second end extending at an angle inwardly towards a central longitudinal axis of the adjustable over handle assembly and on opposite sides of the adjustable overhead handle assembly.

20. The adjustable overhead handle assembly of claim 13, wherein the first end of the rotational stop of each of the left and right pivot mounts engages the stop pin of each of the left and right pivot mounts in response to the left and right adjustable handles being in the first position, and wherein the second end of the rotational stop of each of the left and right pivot mounts engages the stop pin of each of the left and right pivot mounts in response to the left and right adjustable handles being in the second position.

* * * * *